United States Patent [19]

Hultberg

[11] 4,169,481

[45] Oct. 2, 1979

[54] ASHTRAY WITH DEPRESSIBLE RESILIENT CENTRAL SECTION

[76] Inventor: Åke A. Hultberg, S-150 30, Mariefred, Sweden

[21] Appl. No.: 821,505

[22] Filed: Aug. 3, 1977

[30] Foreign Application Priority Data

Aug. 4, 1976 [SE] Sweden ..... 7608733

[51] Int. Cl.[2] ..... A24F 19/04

[52] U.S. Cl. ..... 131/237; 131/242

[58] Field of Search ..... 131/231, 237, 241, 248, 131/235 R; 220/20.5

[56] References Cited

U.S. PATENT DOCUMENTS

| | | | |
|---|---|---|---|
| 1,937,084 | 11/1933 | Janssen | 220/20.5 |
| 2,019,227 | 10/1935 | Jasper | 131/242 |
| 2,359,685 | 10/1944 | Schwartz | 131/237 |
| 2,410,606 | 11/1946 | Michyeta | 131/237 X |
| 2,545,019 | 3/1951 | Zunch, Jr. | 131/237 |
| 2,626,045 | 1/1953 | Van Over et al. | 131/241 |
| 2,659,513 | 11/1953 | Morin | 131/237 X |

*Primary Examiner*—Stephen C. Pellegrino

[57] ABSTRACT

An ashtray having an ash collecting container and a lid therefore having a central aperture. A vertically extending depressible central member is positioned in the container so as to have a peripheral outer seating surface normally biased into sealing engagement within the aperture of the lid.

11 Claims, 1 Drawing Figure

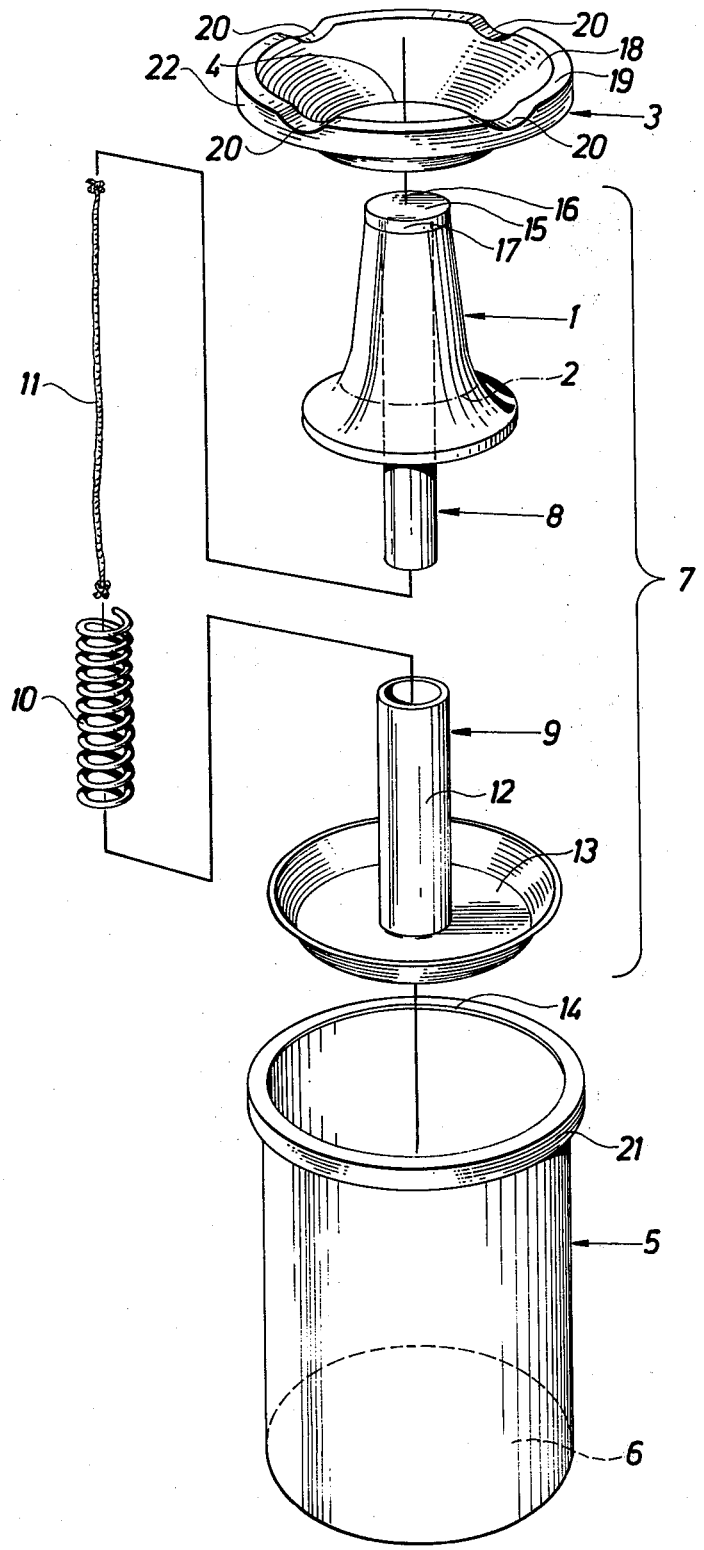
20
20
18
22
4
19
3
20
20
16
15
17
1
2
11
8
7
10
9
12
13
14
21
5
6

ASHTRAY WITH DEPRESSIBLE RESILIENT CENTRAL SECTION

BACKGROUND OF THE INVENTION

The present invention relates to ashtrays and in particular to ashtrays having an ash collecting container and a lid positioned at the upper end thereof within which a central depressible resilient section is mounted to form a mating seal with the lid.

It has been known heretofore to provide ashtrays in which the central portion is depressible and is biased so as to automatically reseat itself upon removal of the depressing force. However, such ashtrays have been relatively complicated in construction and, therefore, comparatively expensive to fabricate. In order to reduce manufacturing costs so that they may be marketed at competitive prices they have frequently been manufactured with a low quality material. Consequently, such ashtrays wear out rapidly and are not resistant to corrosion due to the character of the materials employed. Since ashtrays of this type are frequently washed it would be desirable to employ materials which are corrosion-resistant; however, since such materials are expensive their use is generally precluded. Further, because the materials used have generally been of an inferior quality and/or possess relatively low strength, portions of the ashtray became easily deformed such that in use the central depressible section no longer engages sealingly with the mating portion of the ashtray.

Adding to the complexity of construction it was conventional to position the central depressible section of the ashtray within the frame so as to be rotatable when depressed so as to cause the ashes to empty into the collecting chamber or container, by centrifugal action. This further added to the complexity and mechanical disadvantages of the known devices.

An object of this invention is to provide an ashtray which can be fabricated easily and which can be marketed at a relatively low price.

Another object of this invention is to provide an ashtray having a central depressible section which is self-seating.

Another object of this invention is to provide an ashtray of the character described which permits depression of the central depressible section without requiring rotation thereof.

Yet another object of this invention is the provision of an ashtray which can be fabricated easily and at low cost but which is still sturdy in construction and which will exhibit great operational longevity such that it can be employed in areas where it will be subject to heavy use such as in restaurants, factories, reception rooms and recreational areas.

It is a further object of this invention to provide an ashtray which will reduce the possibility of air pollution by unextinguished cigars and cigarettes deposited in the container and also the risk of fire from glowing embers or sparks which may be emitted by such cigars and cigarettes.

Other objects and advantages of the invention will become readily apparent from the ensuing description of the invention.

SUMMARY OF THE INVENTION

According to the present invention there is provided an ash collecting container having a lid through which is formed a central aperture. Vertically extending through the aperture is a depressible member having a peripherally extending outer seating surface adapted into sealing engagement with the lid. An upper portion of the depressible member projecting upwardly through the lid aperture while the seating surface is angularly inclined relative to the cooperable engaging surface of the lid. Means for normally biasing the depressible member upwardly into sealing engagement with the lid is also provided.

BRIEF DESCRIPTION OF THE DRAWING

In order that the invention may be more fully comprehended it will now be described, by way of example, with reference to the accompanying drawing, which is an exploded perspective view of an ashtray embodying the features of the invention.

DETAILED DESCRIPTION OF THE INVENTION

Referring to the drawing there is shown an ashtray comprising an ash storage container 5 surmounted by a securable lid 3 having a central hole defined by a tapered inner peripheral edge 4. A movable ash transport assembly is located within the container and includes a central depressible member 1, which extends through the hole 4, and a support member 13 seated within the container 5. Cooperating axially extending guide members 8 and 9, permitting axial but not radial movement, are integrally formed with the depressible and support members 1 and 13 respectively. A compression coil spring member 10 is housed within the guide members and is provided with retaining cord or string 11 which connects the opposed ends of the spring loaded depressible member 1 and the support member 13 so as to retain the assembly in connected resiliently outward biased form.

The central depressible member 1 extends generally vertically and is desirably given a conical or generally bell-shape exterior surface. As depicted in the drawing, such member is bell-shaped and flares outwardly at its lower extremity. The exterior contour of member 1 is selected so as to provide a seating surface 2 (shown by phantom line) which is located along a line closer to the vertical axis of the member than the lower peripheral edge of the member. The taper of member 1 in its upper portion is preferably at an angle of from 20° to 30° with its vertical axis. The lower flared portion of member 1 forms an angle with the vertical axis desirably between approximately 90° and 120°. Thus, under the influence of spring 10 the depressible member 1 is normally urged upwardly such that seating surface 2 is biased into sealing engagement with the inner periphery 4 of the lid defining the central aperture therein. Due to the exterior surface of the depressible member 1 being angularly inclined relative to the mating surface on the lid wedging or clamping of the depressible member within the aperture of the lid is avoided so as to enhance the depressible characteristic of member 1.

The intermediate portion of member 1 extending upwardly above the seating surface 2 tapers inwardly so as to be spaced from the adjacent periphery of the lid and is surmounted by a transparent element 15 which may be a lens. Such element 15 may be separate from the member 1 and affixed thereto by means of a force fit between axially extending protrusions at the end surface of member 1. If desired, element 15 may be given a convex upper surface. The object of providing element 15 of a transparent material is so that it will be possible, whenever desired, to position advertising material or a company trademark or logo beneath the lens for viewing therethrough.

The ash collecting container 5 is desirably a hollow cylindrical member closed at one end and open at its other end. A cylindrical metal can, for example, may be employed such as an oil can. The size which has been found to be most suitable ranges from a quarter to a full liter can. Such a can may be easily and inexpensively replaced, when necessary, due to damage to the initial container. As will be appreciated, if desired one may provide this container with an encircling self-adhesive wrapper upon which is imprinted the desired advertising matter. Such wrapper is not shown in the drawing.

The ash collecting container 5 is preferably given a peripheral flange 14 at its upper edge. A washer or gasket 21 of rubber or like material may be secured to the exterior of container 5 to effect sealing between the upper end of the container at its outer surface and a collar 22 provided on the lid so as to depend annularly therefrom.

The lid 3 of the ashtray is desirably annular in configuration and includes a peripheral edge surface 19 from which collar 22 depends. The lid is given an upper surface 18 which slopes downwardly and inwardly to terminate in inner periphery 4 which defines the central aperture of the lid. The generatrix for surface 18 may be curved as in a spherical seat or may be straight as in a conical surface. Extension of the generatrix downwardly forms an angle with the longitudinal axis of assembly 7 (in the case of a curved generatrix this would be an average angle) which may vary within rather wide limits, but which is preferably between approximately 40° and 50°.

The upper edge 19 of the lid is provided with at least one generally tangential depression or recess 20 adapted to support a cigarette or light smoking article therein. As shown in the drawing four such recesses 20 are desirably provided in circumferentially spaced relation about upper edge 19.

As stated above, the lid is dimensioned and shaped so as to be complementary to the surface of the container 5. In order to secure the lid, cooperating threads, recesses and detents may be provided. In any event, the lid is dimensioned so that it may be force fit within the upper end of the container, i.e., within flange 14 of the container. Such force fit will provide the desired radial seal between the lid and the flange. Collar 22 of the lid depends therefrom so as to provide an outer radial seal between washer 21 and the collar. Thus, a double seal arrangement is provided to prevent the escape of smoke or glowing embers and sparks which may be emitted from the cigars or cigarettes deposited in container 5. Such double seal also serves to minimize the admission of air into the container and thereby contributes to the extinguishing of any flame or sparks which may exist within the container.

As previously stated, assembly 7 includes depressible member 1 and support member 13. The support member 13 is desirably in the form of a dish-like shallow bowl and is given an outer diameter which is slightly less than that of the inner diameter of container 5 thereby providing a small clearance therebetween. In this manner support member 13, when positioned within the container, may be employed as a base to center the depressible member 1 within the aperture of the lid as will become clear.

A pair of guide members 8, 9 are provided and are connected respectively to extend along the central axis of the depressible member 1 and support member 13. One of such members, as shown guide member 9, is a sleeve whereas the other guide member is a rod dimensioned only negligibly smaller so to fit slidably within the sleeve. In this manner the depressible member 1 and support member 13 are slidably interconnected. Within sleeve 9 there is positioned the coil spring 10, and the retainer string 11. The string 11 is secured at one end to the top (e.g., lens 15) of the depressible member 1 and at its other end to the bottom of the support member 13. Both of the latter members may be completely hollow and have inward hooks for the string, or may have closed ends provided eyes through which the string can be threaded and knotted, such as a needle. The spring 10 is suitably positioned within the guide members such that depressible member 1 is normally biased upwardly to effect sealing engagement of its seating surface 2 with inner periphery 4 of lid 3 while the support member 13 is urged against the bottom of container 5. In this manner support member 13 serves to center the guide sleeve 9 and guide rod 8 so as to insure proper seating of the depressible member within the central aperture of the lid.

It will be understood, of course, that the coil spring 10 is selected to have the desired spring constant and length necessary to achieve seating of the depressible member within the aperture of the lid without jamming of the seating surface so as to require undue force in depressing the member to transfer ashes and cigarettes, etc., downwardly into container 5. The spring action should, however, be sufficient to effect positive seating of the depressible member upon removal of the depressing force such that it is self-seating. The end face of guide rod 8 may be utilized to retain the upper end of the spring, the lower end of which would bear either against a spring retaining projection within the guide sleeve 9 or against the closed bottom of support member 13. It will be appreciated that it is also possible to so dimension guide rod 8 that it is provided with a bore of sufficient diameter to accommodate spring 10 therewithin in which event spring retaining means may be provided within the guide rod. Other constructions for support of the spring so as to exert the desired biasing force upon depressible member 1 and support member 13 may be employed. Retaining string 11 serves the purpose of limiting the extent of separation of depressible member 1 and support member 13. Thus, members 1 and 13 constitute a resilient assembly.

It will be understood further that container 5 may possess a configuration in cross-section which need not be circular but which, for example, may be polygonal. However, the configuration of lid 3 should be complementary since it is secured atop the container by frictional engagement with its upper end. Also, depressible member 1, particularly at seating surface 2, should be given a configuration in cross-section which is complementary to inner periphery 4 of the lid.

Various modifications and changes have been suggested in the foregoing description. Others will be obvious to those skilled in this art. Consequently, it is intended that the present disclosure be illustrative only and not limiting of the scope of the invention.

What is claimed is:

1. An ashtray having a central depressible resilient section comprising:

an ash collecting container;

a lid, having a central aperture, mounted on said container;

a vertically extending depressible member having a peripherally extending outer seating surface normally biased into sealing into sealing engagement with said lid within the aperture thereof, an upper portion of said depressible member projecting upwardly through said lid aperture and said seating surface being angularly inclined relative to the cooperable engaging surface of the lid;

a support member located in said container, a guide rod secured to one of said depressible and support members and a guide sleeve provided on the other of said depressible and support members, said guide rod being dimensioned to slide within said guide sleeve to telescopically connect said depressible and support members, said guide rod is secured within said depressible member so as to depend therefrom, said support member including a transversely extending dish-like portion given a peripheral configuration complementary with the inner surface of the container and dimensioned to provide a relatively small clearance therewith, said guide sleeve being secured to the center of said dish-like portion to project upwardly therefrom, said support member thus serving to center the guide sleeve and rod so as to insure proper seating of said depressible member within the aperture of said lid.

2. An ashtray having a central depressible resilient section comprising:

an ash collecting container;

a lid, having a central aperture, mounted on said container;

a vertically extending depressible member having a peripherally extending outer seating surface normally biased into sealing engagement with said lid within the aperture thereof, an upper portion of said depressible member projecting upwardly through said lid aperture and said seating surface being angularly inclined relative to the cooperable engaging surface of the lid;

a support member located in said container, a guide rod secured to one of said depressible and support members and a guide sleeve provided on the other of said depressible and support members, said guide rod being dimensioned to slide within said guide sleeve to telescopically connect said depressible and support members, and biasing means comprising a coil spring positioned within said sleeve and including retaining string means securing one end of said spring to said depressible member and the other end of said spring to said support member, whereby said depressible member is biased upwardly and said support member is biased downwardly as a unitary resilient assembly.

3. An ashtray according to claim 2, wherein said depressible member is tapered upwardly and towards the longitudinal axis thereof, the lower extremity of said depressible member flaring outwardly and said seating surface being located above the lower extremity thereof and closer the longitudinal axis of the member than the lower edge thereof.

4. An ashtray according to claim 2, wherein said depressible member is bell-shaped.

5. An ashtray according to claim 2, including a support member resiliently connected to said depressible member and normally biased downwardly into said container.

6. An ashtray according to claim 2, wherein the upper extremity of said depressible member comprises a transparent element.

7. An ashtray according to claim 2, wherein said lid is dimensioned to be force-fit within the upper portion of said container.

8. An ashtray according to claim 7, wherein the upper portion of said container is provided with a peripheral flange and said lid is force-fit within said flange.

9. An ashtray according to claim 8, wherein said lid includes an outer annular collar and said lid is mounted on said container with said collar positioned outwardly of said flange, a washer being positioned in sealing relation between said flange and said collar.

10. An ashtray according to claim 2, wherein said lid includes an upper surface which slopes inwardly and downwardly and which defines at the inner extremity thereof said lid aperture.

11. An ashtray according to claim 10, including at least one generally tangential depression in the upper edge of said lid dimensioned to support therein a cigarette or like smoking article.

* * * * *